US008373566B2

(12) United States Patent
Yang

(10) Patent No.: US 8,373,566 B2
(45) Date of Patent: Feb. 12, 2013

(54) SECURITY APPARATUS WITH TETHER

(76) Inventor: Xiao Hui Yang, Los Altos, CA (US)

( * ) Notice: Subject to any disclaimer, the term of this patent is extended or adjusted under 35 U.S.C. 154(b) by 0 days.

(21) Appl. No.: 13/478,936

(22) Filed: May 23, 2012

(65) Prior Publication Data

US 2012/0229975 A1 Sep. 13, 2012

Related U.S. Application Data

(63) Continuation-in-part of application No. 13/177,447, filed on Jul. 6, 2011, which is a continuation-in-part of application No. 13/151,106, filed on Jun. 1, 2011, which is a continuation-in-part of application No. 12/815,380, filed on Jun. 14, 2010, now Pat. No. 8,334,776, and a continuation-in-part of application (Continued)

(51) Int. Cl.
*G08B 13/14* (2006.01)

(52) U.S. Cl. ..... 340/572.9; 340/572.1; 340/10.1

(58) Field of Classification Search ..... 340/572, 340/10, 505

See application file for complete search history.

(56) References Cited

U.S. PATENT DOCUMENTS

| | | | | |
|---|---|---|---|---|
| 4,086,795 | A | 5/1978 | Foster | |
| 4,620,182 | A | 10/1986 | Keifer | |
| 4,756,171 | A | 7/1988 | Homar | |
| 4,776,188 | A | 10/1988 | Dalaba | |
| 4,893,853 | A | 1/1990 | Guiler | |
| 4,896,517 | A | 1/1990 | Ling | |
| 4,962,369 | A | 10/1990 | Close | |
| 5,156,028 | A | 10/1992 | Jiang | |
| 5,337,459 | A | 8/1994 | Hogan | |
| 5,565,848 | A | 10/1996 | Leyden | |
| 5,570,080 | A | 10/1996 | Inoue | |
| 5,722,266 | A | 3/1998 | Yeager | |
| 5,764,147 | A | 6/1998 | Sasagawa | |
| 5,767,773 | A | 6/1998 | Fujiuchi | |
| 5,786,759 | A | 7/1998 | Ling | |
| 5,794,464 | A | 8/1998 | Yeager | |
| 5,856,782 | A | 1/1999 | Sasagawa | |
| 5,959,532 | A | 9/1999 | Fujiuchi | |
| 6,020,819 | A | 2/2000 | Fujiuchi | |
| 6,092,401 | A | 7/2000 | Sankey | |
| 6,140,923 | A | 10/2000 | Lam | |
| 6,177,869 | B1 | 1/2001 | McDaid | |
| 6,237,375 | B1 * | 5/2001 | Wymer | 70/14 |
| 6,420,971 | B1 | 7/2002 | Leck | |
| 6,550,293 | B1 | 4/2003 | Delegato | |
| 6,624,753 | B2 | 9/2003 | Elston | |
| 6,731,212 | B2 | 5/2004 | Hirose | |
| 6,755,055 | B2 | 6/2004 | Sedon | |
| 7,162,899 | B2 | 1/2007 | Fawcett | |
| 7,168,275 | B2 | 1/2007 | Fawcett | |

(Continued)

*Primary Examiner* — Travis Hunnings

(74) *Attorney, Agent, or Firm* — Waters Law Group, PLLC; Robert R. Waters; Brian W. Foxworthy

(57) ABSTRACT

An electronic article surveillance (EAS) security apparatus is comprised of a base, a reel housing containing a reel, a tether joined to the base and the reel housing and disposed on the reel, and an electronics package. The base attaches to an object to be protected and the tether is wrapped around the object as the reel housing is passed around the object. The reel housing is releasably attached to the base by complimentary coupling elements on each. The base has a tether guide, which allows the tether to be redirected in additional directions as it is wrapped around the object. A releasable blocking mechanism keeps the base and reel housing coupled. The electronics package includes at least a passive EAS element and can contain a microprocessor, wireless communication elements, switches, sound generator, a power supply, and the tether if electrically conductive. The blocking mechanism may be magnetically releasable.

24 Claims, 9 Drawing Sheets

Related U.S. Application Data

No. 13/010,571, filed on Jan. 20, 2011, which is a continuation-in-part of application No. 12/726,879, filed on Mar. 18, 2010, now Pat. No. 8,305,219, which is a continuation-in-part of application No. 12/498,367, filed on Jul. 7, 2009, now Pat. No. 8,274,391, which is a continuation-in-part of application No. 12/391,252, filed on Feb. 23, 2009.

(60) Provisional application No. 61/186,889, filed on Jun. 14, 2009, provisional application No. 61/030,932, filed on Feb. 22, 2008, provisional application No. 61/030,929, filed on Feb. 22, 2008.

(56) References Cited

U.S. PATENT DOCUMENTS

| | | | | |
|---|---|---|---|---|
| 7,227,467 | B2 | 6/2007 | Feibelman | |
| 7,239,238 | B2 | 7/2007 | Tester | |
| 7,251,966 | B2 | 8/2007 | Fawcett | |
| 7,350,381 | B2 | 4/2008 | Fawcett | |
| 7,400,254 | B2 * | 7/2008 | Yang et al. | 340/572.1 |
| 7,403,118 | B2 | 7/2008 | Belden, Jr. | |
| 7,474,209 | B2 | 1/2009 | Marsilio et al. | |
| 7,474,222 | B2 * | 1/2009 | Yang et al. | 340/572.8 |
| 7,481,086 | B2 | 1/2009 | Fawcett | |
| 7,497,100 | B2 | 3/2009 | Fawcett | |
| 7,497,101 | B2 * | 3/2009 | Fawcett et al. | 70/57 |
| 7,522,048 | B2 | 4/2009 | Belden, Jr. | |
| D599,693 | S | 9/2009 | Sayegh | |
| 7,659,817 | B2 | 2/2010 | Conti | |
| 7,685,850 | B2 | 3/2010 | Nilsson | |
| D628,923 | S | 12/2010 | Sayegh | |
| D628,924 | S | 12/2010 | Sayegh | |
| 7,918,112 | B2 | 4/2011 | Fawcett | |
| 8,144,014 | B1 * | 3/2012 | Yang | 340/572.1 |
| 2006/0220848 | A1 | 10/2006 | Tropper | |
| 2006/0250241 | A1 * | 11/2006 | Renzetti et al. | 340/572.1 |
| 2009/0212920 | A1 | 8/2009 | Yang | |
| 2009/0289798 | A1 * | 11/2009 | Yang | 340/572.8 |
| 2010/0171621 | A1 * | 7/2010 | Yang | 340/572.9 |
| 2010/0214102 | A1 * | 8/2010 | Yang | 340/572.9 |
| 2010/0315239 | A1 * | 12/2010 | Yang | 340/572.9 |
| 2011/0115632 | A1 * | 5/2011 | Yang | 340/572.8 |
| 2011/0121973 | A1 * | 5/2011 | Yang | 340/572.8 |
| 2011/0227706 | A1 * | 9/2011 | Yang | 340/10.1 |
| 2011/0260594 | A1 * | 10/2011 | Yang | 312/297 |

* cited by examiner

SECURITY APPARATUS WITH TETHER

CROSS REFERENCE TO RELATED APPLICATIONS

This application is a continuation-in-part of U.S. application Ser. No. 13/177,447 filed on Jul. 6, 2011. U.S. application Ser. No. 13/177,447 is a continuation-in-part of U.S. application Ser. No. 13/151,106 filed on Jun. 1, 2011, which in turn is a continuation-in-part of U.S. patent application Ser. No. 12/815,380 (now U.S. Pat. No. 8,334,776), filed on Jun. 14, 2010, and U.S. patent application Ser. No. 13/010,571 filed on Jan. 20, 2011. U.S. patent application Ser. No. 12/815,380 (now U.S. Pat. No. 8,334,776) in turn claims priority to U.S. Provisional Application 61/186,889 filed on Jun. 14, 2009. U.S. patent application Ser. No. 13/010,571 is a continuation-in-part application based on U.S. patent application Ser. No. 12/726,879 (now U.S. Pat. No. 8,305,219) filed on Mar. 18, 2010. U.S. patent application Ser. No. 12/726,879 (now U.S. Pat. No. 8,305,219) is a continuation-in-part application based on U.S. patent application Ser. No. 12/498,367, (now U.S. Pat. No. 8,274,391) filed on Jul. 7, 2009. U.S. patent application Ser. No. 12/498,367 (now U.S. Pat. No. 8,274,391) is a continuation-in-part application based on U.S. patent application Ser. No. 12/391,252 filed on Feb. 23, 2009, in turn claiming priority to U.S. Provisional Application 61/030,929, filed on Feb. 22, 2008, and U.S. Provisional Application 61/030,929 filed on Feb. 22, 2008. The entire disclosures contained in U.S. patent applications Ser. Nos. 13/177,447, 13/151,106, 12/815,380, 13/010,571, 12/726,879, 12/498,367, and 12/391,252, U.S. Pat. No. 8,334,776, U.S. Pat. No. 8,305,219, U.S. Pat. No. 8,274,391, U.S. Pat. No. 8,144,014 and U.S. Provisional Applications 61/186,889, 61/030,932, and 61/030,929, including the attachments thereto, are incorporated herein by reference.

FIELD OF THE INVENTION

This application relates to the field of electronic article surveillance (EAS) and security. In particular, this application relates to EAS systems that wrap elements around an object to be protected and monitor the elements with electronics in associated housings.

BACKGROUND OF THE INVENTION

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In the earliest EAS systems passive EAS elements were used in the EAS tags. In systems using passive elements, an interrogation field is created at control locations, such as exits, by transmitting antennas. The transmitting antennas intermittently create a field in their near surroundings. This field and the passive EAS element are tuned to each other. If an EAS tag having a passive element enters an interrogation field, the field energizes the passive element which allows the passive element to produce a signal. The passive element may be of a type that produces a signal that is a harmonic of the interrogation field or a signal that resonates with the interrogation field.

More recently developed EAS systems employ wireless communication with the EAS tags. The electronics onboard the EAS tags are more sophisticated. Some systems may employ radio frequency communication as the wireless communication, while others may employ optical communication, such as infrared communication. Some may employ both radio frequency and optical communication. Additionally, EAS systems employing wireless communication may also employ passive elements in the tags as well.

In order to make an EAS system effective, one must consider how to make the EAS tags tamper resistant. This is an on-going effort, because over time, thieves become more clever in learning how to tamper with an EAS tag to defeat it. The retailer (and the tag manufacturer) must consider how to detect and prevent tampering with the tags. The particular construction of a tag will determine how tampering is detected.

RELATED ART

U.S. Pat. No. 7,474,209 by Marsilio et. al is for a "Cable Alarm Security Device." A security device for attachment to an article to deter theft of the article has a housing containing an alarm system including an audible alarm and an LED. A cable has one end attached to the housing and a second end attached to a plug which is selectively inserted into and locked to the housing. The cable includes a conductor electrically connected to the alarm system when in the locked position. The audible alarm is activated if the integrity of the cable is compromised. An EAS tag located in the housing will actuate an alarm at a security gate and can actuate the audible alarm of the security device when the device is in proximity to a security gate. The LED is positioned in the housing to be visible from both sides of the housing. A magnetically attractable lock mechanism releasably secures the cable plug in the locked position.

U.S. Pat. No. 5,722,266 by Yeager et al. is for a "Universal Wrap Security Device." A security device includes a locking member, a ratchet member, and a plurality of cables. The cables extend through both a fastener and a base of the locking member and are wrapped around all six sides of a book or box-like structure. The fastener is releasably snap-fitted into the base and secured therein by a pair of metal tines. The ratchet member includes a housing containing a gear and bearing member which are latched together in a spaced relationship to form a reel and a pawl. A bottom plate encloses the contents of the housing. The gear includes a multi-sided key hole, a plurality of openings to secure enlarged ends of the cables therein, and a plurality of teeth. The gear and bearing member each include an annular nub which sits in and rotates around a corresponding bearing surface of the bottom plate and housing, respectively. The pawl has a catch and a resilient spring and communicates with the gear to allow the ratchet member to be turned only in one direction. Two specialized tools are required to tighten the device around the box-like structure and to remove the security device from the same.

U.S. Pat. No. 7,162,899 by Fawcett et al. is for a "Cable Wrap Security Device." A security device includes a locking member, a ratchet mechanism, and a plurality of cables. The cables extend through both a fastener and a base of the locking member and are wrapped around all six sides of a box-like structure. The fastener is releasably snap-fitted into the base of the locking member and secured therein by a magnetically attractable tine. The ratchet mechanism includes a housing containing a spool and a locking pawl. A bottom wall encloses a portion of the housing and includes a rotatable central portion having a key receiving recess for unlocking the spool from the pawl. The housing has a rotatable top wall portion which includes a flip-up handle for rotating the top wall portion and the internal ratchet to tighten the cable about an article. An alarm system is contained in the housing of the ratchet mechanism and actuates an audible alarm upon certain unauthorized actions occurring. An LED located within the housing provides a visual indication that the alarm system is activated.

U.S. Pat. No. 7,685,850 by Nilsson is for a "Security Wrapper." A security device comprises a retaining member forming an adjustable loop, including a cable; a ratchet member connected to the cable, operable to narrow the loop and to prevent widening of the loop, including a first main part comprising a gear ring extending in a first plane with a saw tooth profile raised from the plane, a second main part, rotatable relative to the first main part, including a latch member biased towards the first plane to engage the gear ring, and a drum for winding up of the cable.

SUMMARY

An electronic article surveillance (EAS) security apparatus is comprised of a base, a reel housing, an electronics package, and an electrically conductive tether connecting the base to the reel housing. The top of the base and the bottom of the reel housing have complimentary coupling elements that allow the reel housing to couple to the base. A releasable locking mechanism prevents the unauthorized separation of the reel housing from the base. When the security apparatus is not installed on an object, the tether is disposed mostly on a reel within the reel housing.

To install the security apparatus, the base affixes to one side of an object to be protected, and the reel housing is passed around the object, so that the tether wraps around the object. The reel housing then attaches to the base for the physical installation of the security apparatus to the object. The base may have a tether guide on its top so that the tether can be redirected after the first pass around the object so that the tether wraps the object in different directions or planes. The base may have an adhesive element on the bottom to facilitate the attachment of the base to the object.

The electronics package may include a passive EAS element, a circuit board, a power supply, a sound generator, a microprocessor, switches, light emitting diodes, and wireless communication elements, including infrared communication elements as well as radio frequency communication elements. Other electronic components may also be present. If the tether is comprised at least partially of an electrically conductive material, its integrity can be monitored by the other electronics by monitoring electrical continuity through the tether. Loss of electrical continuity could indicate a cut tether. In some embodiments, the electronics package is housed in the base.

The microprocessor can monitor inputs from various switches, wireless communication elements, and the tether to status of the security apparatus. A switch on the bottom of the base can monitor whether the base is setting on an object. An assembly switch can monitor whether the reel housing has been coupled to the base. Communication from an external device through the wireless communication elements can perform a final arming step once the security apparatus is physically installed on an object. Electrical continuity of the tether indicates the tether is intact. Changes in state of inputs without an external signal for disarming can cause the microprocessor to determine that an alarm condition exists. When an alarm condition is determined, the microprocessor can issue alarms with the sound generator or by communication with the larger electronic article surveillance system via the wireless communication elements. The passive EAS element can also interact with the larger electronic article surveillance system.

The releasable locking mechanism prevents the unauthorized separation of the reel housing from the base and may be magnetically releasable. In at least one embodiment, the releasable locking mechanism comprises a spring biased magnetically attractable blocking pin in either the base or the reel housing and a complementary recess in the other unit. When the reel housing is coupled to the base the blocking pin aligns with the recess and inserts into it. A magnet can move the pin out of the recess in order to allow the removal of the reel housing. If the microprocessor has not received a disarming signal from an external device, an assembly switch may have its status change upon removal of the reel housing and the microprocessor may determine an alarm condition and act according to its instructions.

Disarming of the security apparatus may be accomplished by authorized personnel. An authorized person having access to other elements of the EAS system such as a hand held communication device, a base station having communication capabilities, or other external devices, may disarm the security apparatus. To transmit the disarming signal, the external device can communicate with the security apparatus via the wireless communication elements.

Some embodiments of the security apparatus will add another element of security with passcode capabilities in the respective electronics. The security apparatus electronics of these embodiments are capable of storing a passcode which is known to the communication elements of the EAS system and which can be used to confirm to the security apparatus that the disarming signal is authorized. A further element of security can be added by using clock based algorithms to change the passcode synchronously. In those embodiments, the EAS system and the EAS security apparatus both have clock generators and are programmed with the same algorithm and both are programmed with the same initial passcode. As time passes, the algorithm alters the passcode at preset intervals as regulated by the clock generators. This changing passcode further complicates unauthorized attempts to disarm the security apparatus. If a security apparatus tag is detached without being disarmed with the appropriate passcode, the security apparatus will determine an alarm condition exists and generate an alarm.

BRIEF DESCRIPTIONS OF THE DRAWINGS

DESCRIPTION OF THE EMBODIMENTS

Figure 1:
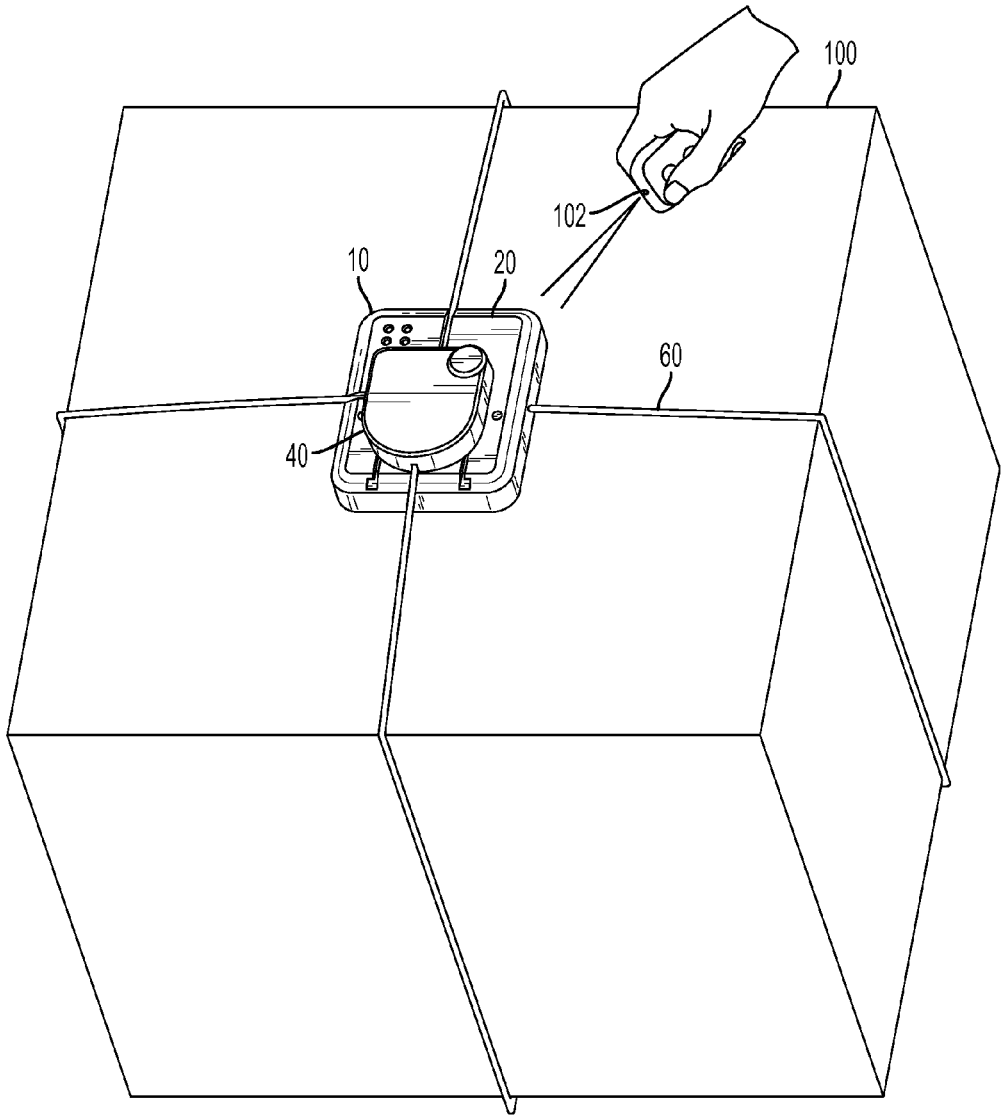
FIG. 1 is a top perspective view of an object being protected with an embodiment of the security apparatus attached.

FIG. 1 is a top perspective view of an object 100 being protected with an embodiment of security apparatus 10 attached. In the embodiment shown in FIG. 1, base 20 is positioned on object 100 and reel housing 40 is joined to base 20. A tether 60 is disposed on a reel within reel housing 40 and a first end 62 of tether 60 is affixed to the reel. Tether 60 extends from reel housing 40, passes around object 100 multiple times, and attaches to base 20 at a second end 64 of tether 60.

Figure 2:
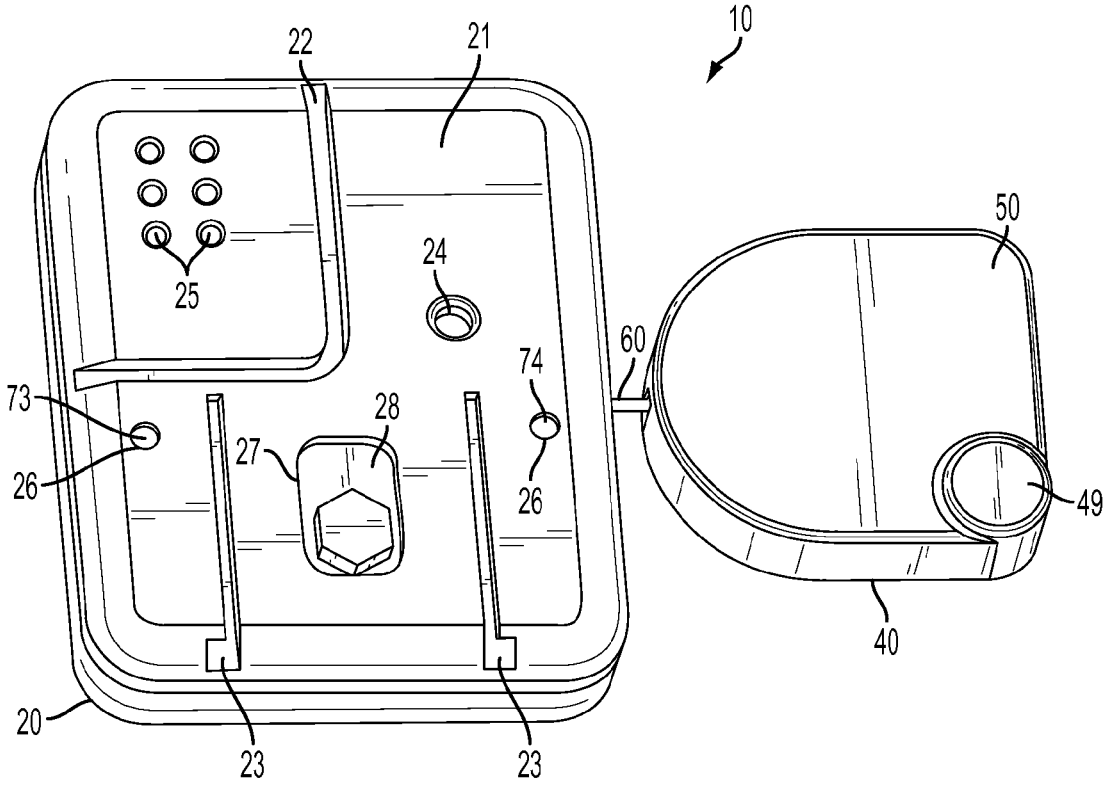
FIG. 2 is a top perspective view of an embodiment of the security apparatus.

FIG. 2 is a top perspective view of an embodiment of the security apparatus 10. In FIG. 2, tether 60 is withdrawn for the most part into reel housing 40, and base 20 and reel housing 40 are shown in close proximity to each other. Several features may be seen on the top 21 of base 20. Among the more visually prominent features on top 21 of base 20 are tether guide 22, slots 23, and recess 24. These features facilitate the assembly of security apparatus 10 to object 100 and its retention in position. Tether guide 22 accepts and redirects tether 60 and allows tether 60 to wrap around object 100 more than once and in multiple directs. Slots 23 are a first part of the coupling mechanism used to join reel housing 40 to base 20, and are formed to be complementary with elements on the bottom of reel housing 40. When reel housing 40 is joined to base 20, recess 24 receives a blocking pin extending from the bottom of reel housing 40. This is the mechanism by which reel housing 40 is releasably locked in place on base 20. Referring back to FIG. 1, it can be seen that when reel housing 40 is joined to base 20, reel housing 40 covers tether guide 22 and tether 60, keeping tether 60 in place in tether guide 22.

Figure 3:
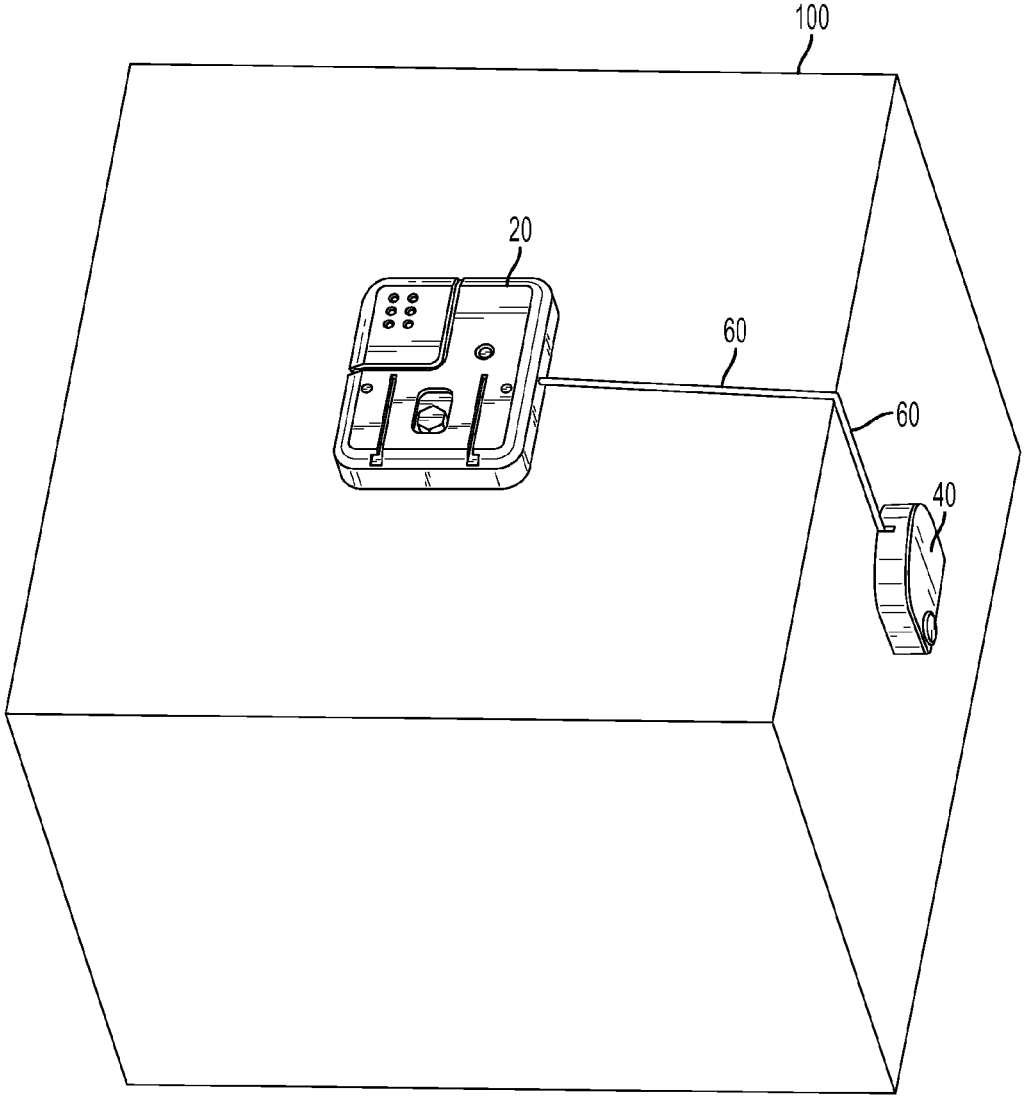
FIG. 3 is a top perspective view of an embodiment of the security apparatus in an initial phase of installation where the reel housing is being pulled away from the base.
Figure 4:
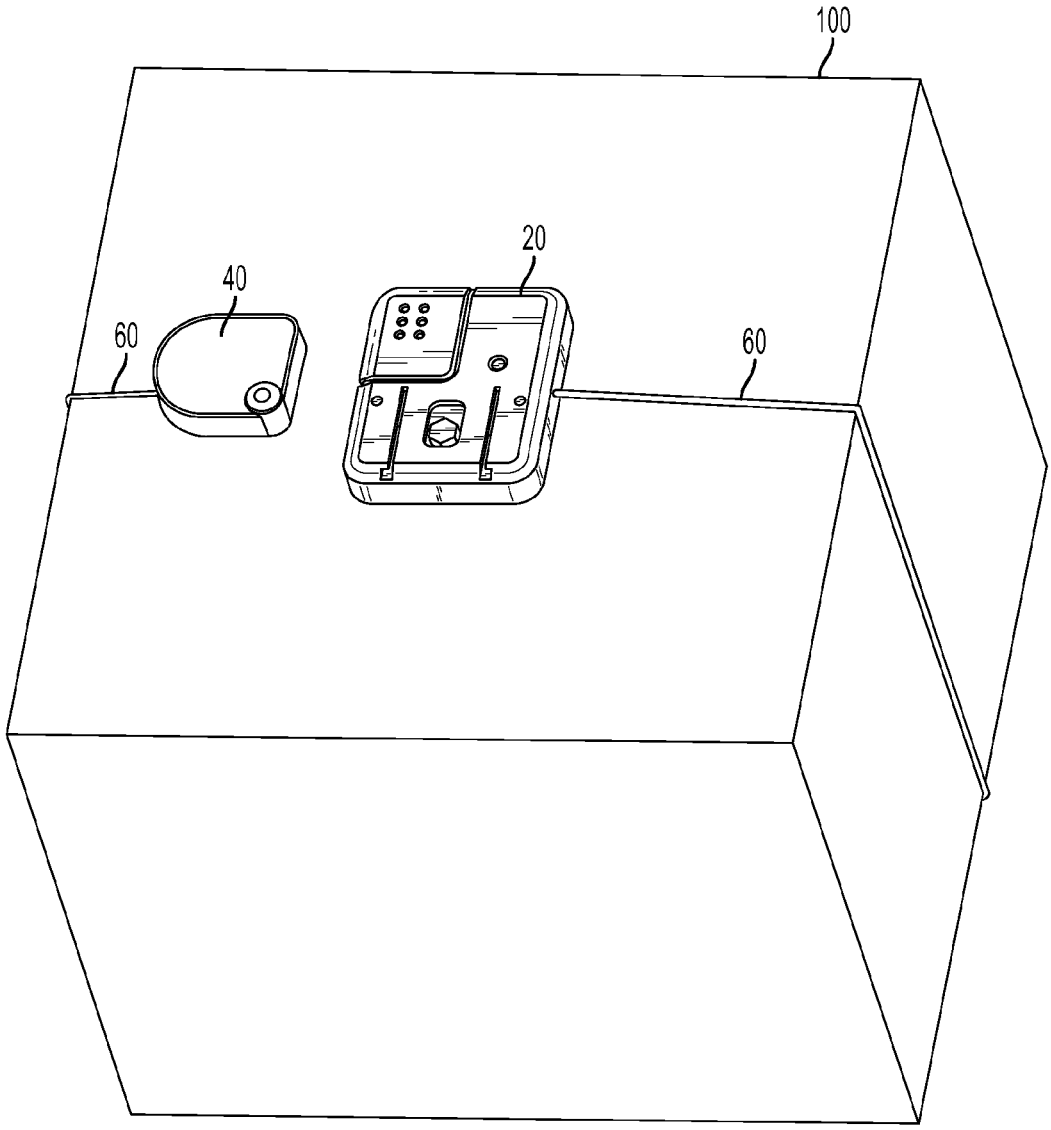
FIG. 4 is a top perspective view of an embodiment of the security apparatus in an intermediate phase of installation where the reel housing is approaching the base for a first time.
Figure 5:
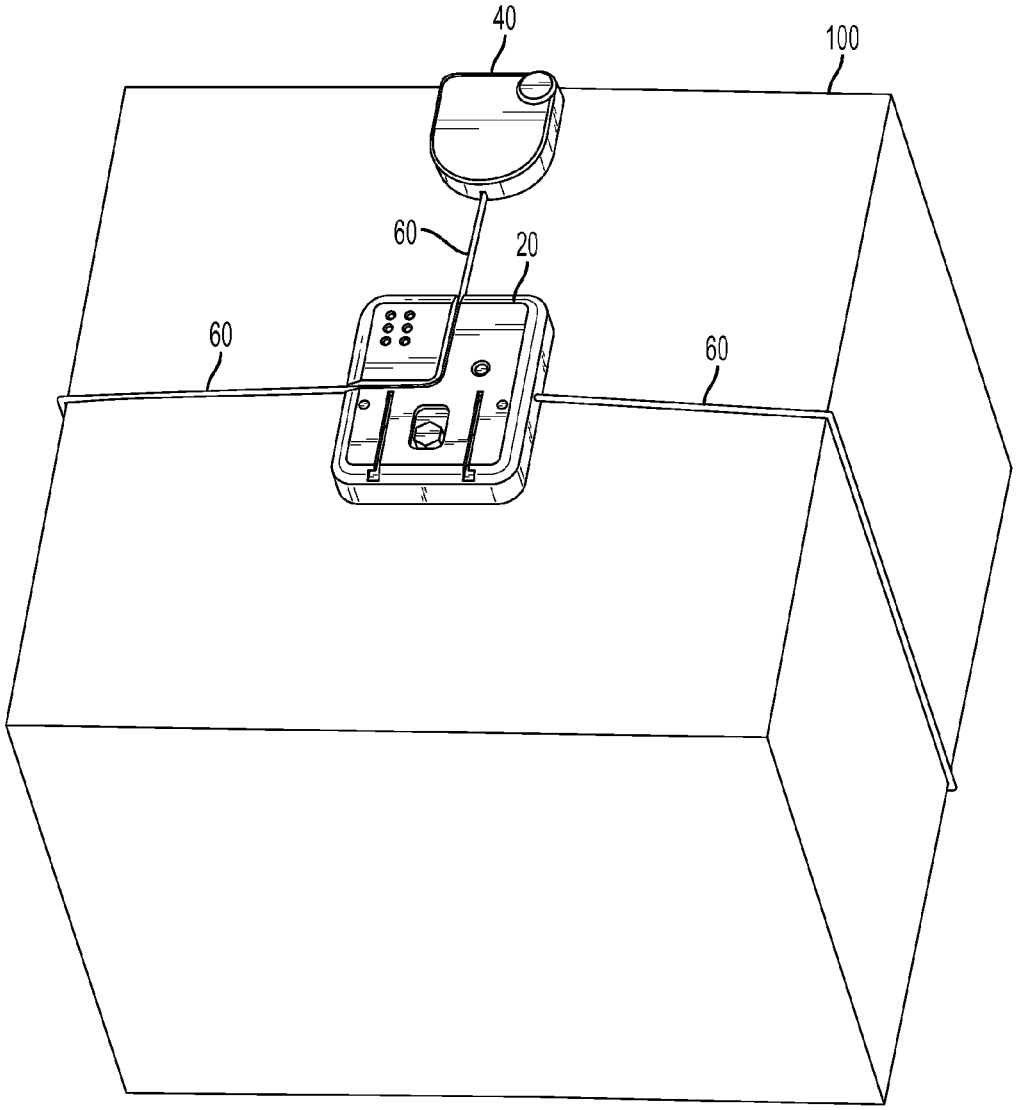
FIG. 5 is a top perspective view of an embodiment of the security apparatus in an intermediate phase of installation where the tether is engaged with the guide and the reel housing is moving away from the base.
Figure 6:
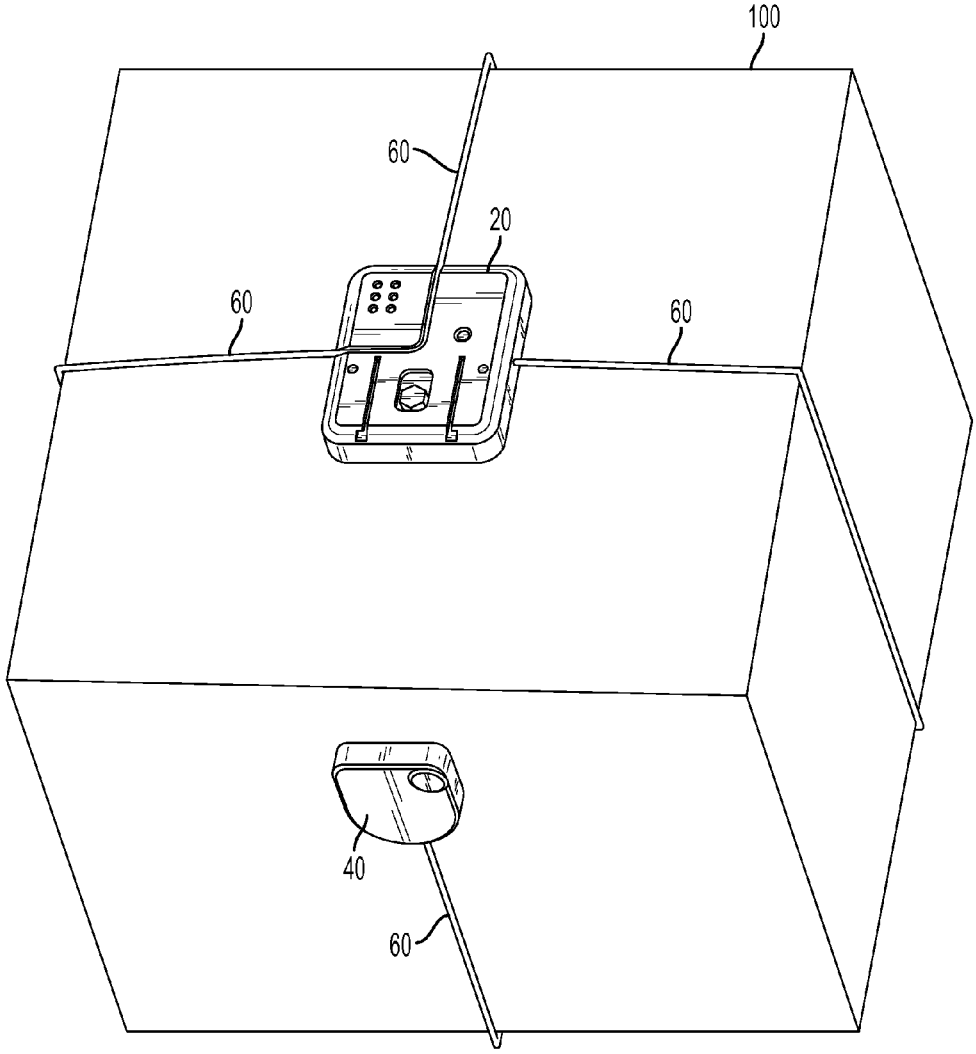
FIG. 6 is a top perspective view of an embodiment of the security apparatus in a latter phase of installation where the reel housing is approaching the base to be joined to the base.

FIGS. 3-6 show the process of installing security apparatus 10 on object 100. FIG. 3 is a top perspective view of an embodiment of security apparatus 10 in an initial phase of installation, where reel housing 40 is being pulled away from base 20 and tether 60 is playing out from the reel within reel housing 40. FIG. 4 is a top perspective view of the embodiment of security apparatus 10 in FIG. 3 in an intermediate phase of installation, where reel housing 40 is approaching base 20 for a first time. FIG. 5 is a top perspective view of the embodiment of the security apparatus 10 of FIGS. 3 and 4 in an intermediate phase of installation, where tether 60 is engaged with tether guide 22 and reel housing 40 is moving away from base 20. FIG. 6 is a top perspective view of the embodiment of security apparatus 10 of FIGS. 3-5 in a latter phase of installation, where reel housing 40 is approaching base 20 to be joined to base 20 by sliding reel housing 40 on the top of base 20. Returning to FIG. 1, where reel housing 40 is shown joined to base 20, it can be seen that reel housing 40 covers tether 60 and tether guide 22 to retain tether 60 in tether guide 22.

In the embodiment of security apparatus 10 of FIGS. 1-6 tether guide 22 is a groove in the top surface 21 of base 20. This embodiment of tether guide 22 provides means of redirecting the direction of tether 60 by 90° so that a single tether 60 may encircle an object 100 in two different planes. However, other embodiments of security apparatus 10 may employ other forms of tether guides. For example, a different embodiment of security apparatus 10 might employ a tether guide comprising a post extending upwardly from top surface 21 of base 20. In such an embodiment of security apparatus 10, tether 60 would wrap around the post, while reel housing 40 would again maintain tether 60 in place. Reel housing 40 could receive the post in a recess, either by vertical assembly to base 20 or by lateral sliding assembly as in the embodiments shown in FIGS. 1-6 and discussed above. Additionally, other embodiments of security apparatus 10 may have tether guides associated with reel housing 40 rather than base 20.

Figure 7:
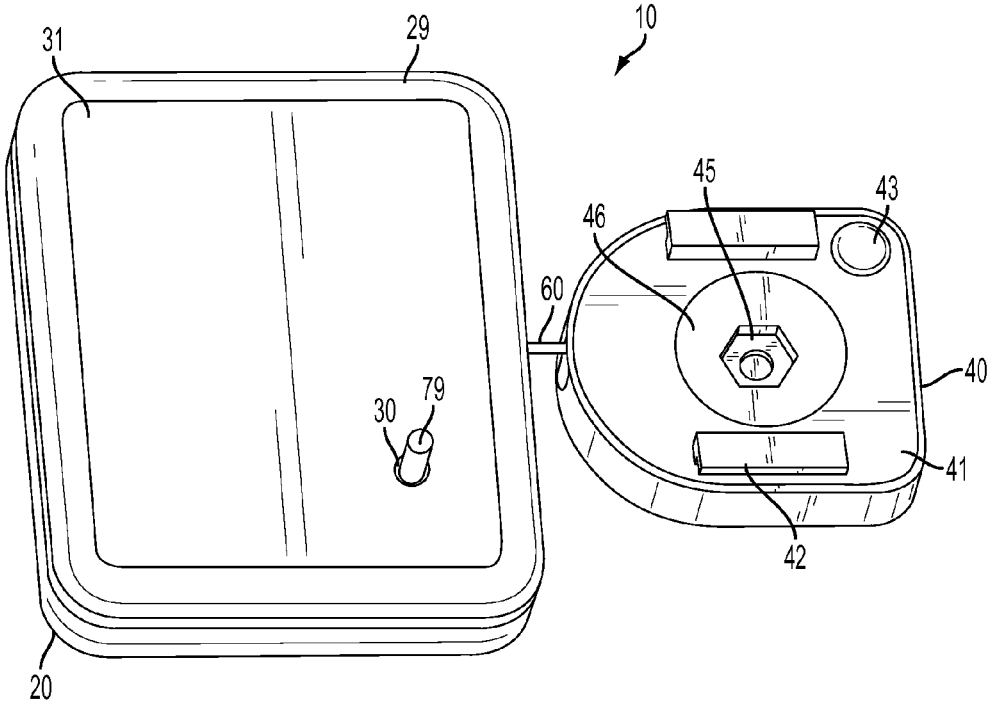
FIG. 7 is a bottom view of the embodiment of the security apparatus shown in FIGS. 1-6.

FIG. 7 is a bottom perspective view of the embodiment of security apparatus 10 shown in FIGS. 1-6. Rails 42 on the bottom 41 of reel housing 40 are a second part of the coupling mechanism used to join reel housing 40 to base 20, and are formed to be complementary with elements, slots 23, on the top 21 of base 20. To couple reel housing 40 to base 20, rails 42 on the bottom 41 of reel housing 40 are aligned with slots 23 on the top 21 of base 20, and reel housing 40 is slid to engage rails 42 in slots 23.

Once reel housing 40 is coupled to base 20, a releasable locking mechanism prevents reel housing 40 being removed from base 20 unless the releasable locking mechanism is released. In the embodiment of security apparatus 10 shown in FIG. 7, reel housing 40 has retractable blocking pin 43 extending from its bottom 41 through pin aperture 51. Base 20 has an recess 24 in its top 21. Recess 24 is located to receive blocking pin 43 when reel housing 40 is slidably coupled with base 20. When reel housing 40 is fully coupled with base 20, blocking pin 43 inserts into recess 24, and blocking pin 43 must be withdrawn from recess 24 to allow reel housing 40 to be decoupled from base 20. In at least one embodiment of reel housing 40, blocking pin 43 is biased to extend from bottom 41 of reel housing 40. In such an embodiment of reel housing 40, blocking pin 43 is compressed up into reel housing 40 when reel housing 40 is initially engaged to base 20 and automatically extends into recess 24 when reel housing 40 is fully coupled to base 20 and blocking pin 43 is aligned with recess 24. In at least one embodiment, blocking pin 43 is made at least partially from a magnetically attractable material. Placing a magnet over blocking pin 43 at the top of reel housing 40 withdraws blocking pin 43 from recess 24 and allows reel housing 40 to slide with respect to base 20 to decouple the two.

While the embodiments of security apparatus 10 shown in FIGS. 2 and 7 require reel housing 40 to be coupled to base 20 with a linear sliding motion. Other coupling elements besides slots 23 and rails 42 could be employed to achieve a coupling of reel housing 40 to base 20. For example, coupling elements utilizing a rotational motion combined with a blocking pin and matching aperture could also be used to couple reel housing 40 to base 20, or base 20 could have a pin or post and reel housing 40 could have a clutch for releasably locking onto the post. Many different coupling methods and mechanisms could be used in addition to those shown in the embodiments of the figures. The mechanism for releasably locking reel housing 40 to base 20 will vary depending upon the particular configuration of the coupling elements and the manner in which reel housing 40 is coupled to base 20.

Figure 8:
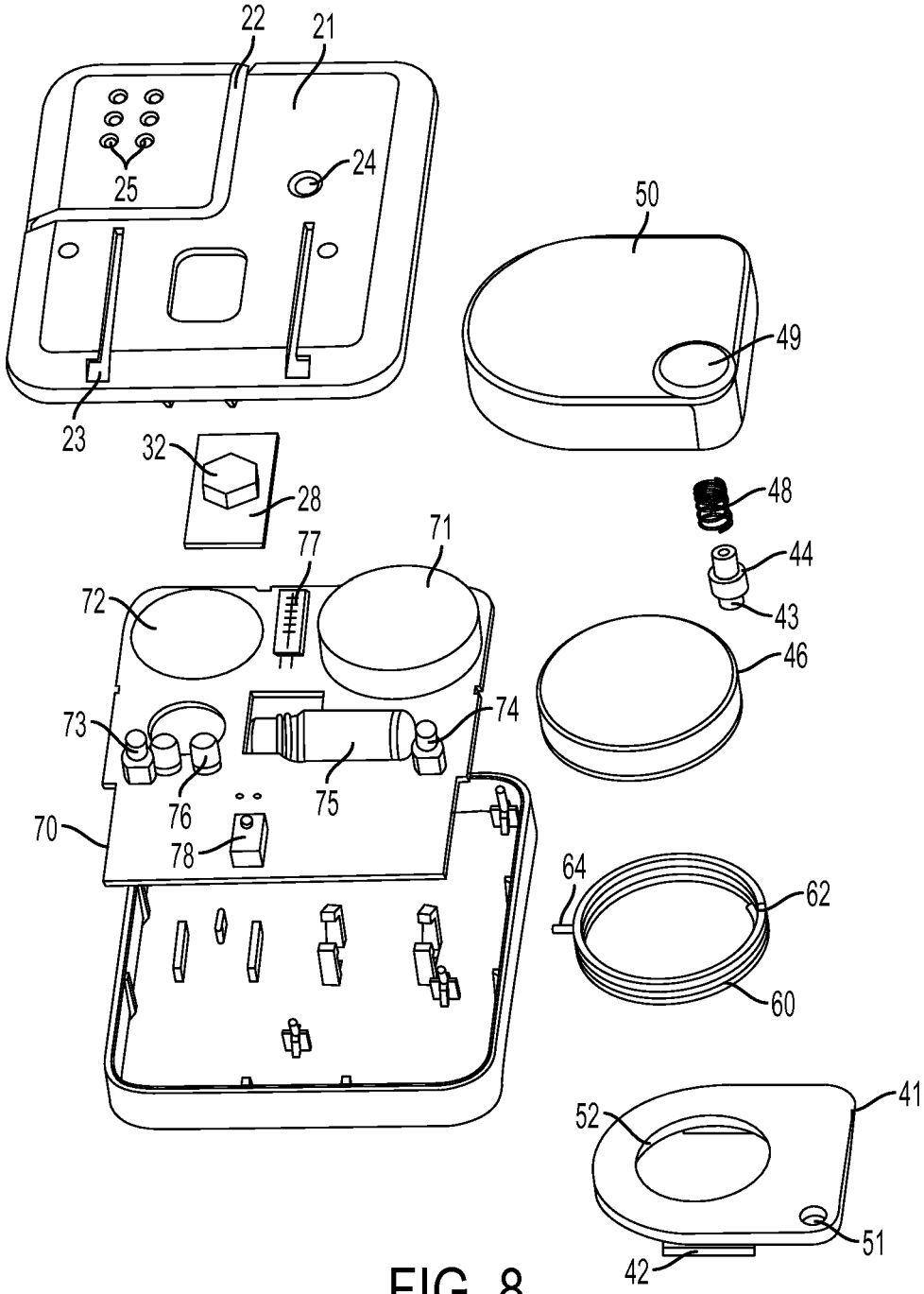
FIG. 8 is an exploded top perspective view of an embodiment of a security apparatus with tether.

Once attached to an object to be protected 100, security apparatus 10 has electronics to perform electronic article surveillance functions. In at least one embodiment of security apparatus 10, the electronics are contained within base 20. FIG. 8 is an exploded top perspective view of an embodiment of a security apparatus with tether. In FIG. 8, it may be seen that base 20 encloses an interior space in which circuit board 70 is located. Circuit board 70 has several electronic elements attached to it, including: microprocessor 71; sound generator 72; optical communication element 73; light emitting diode (LED) 74; passive electronic article surveillance (EAS) element 75; onboard power supply 76; radio frequency (RF) receiving and transmitting circuitry 77; and assembly switch 78.

Top 21 of base 20 has several apertures aligned with several electronic elements and at least one aperture to accommodate a mechanical feature. Audio apertures 25 are positioned over sound generator 72 to facilitate the exit of sounds from base 20. Optical apertures 26 align with optical communication element 73 and LED 74 and allow optical communication via those elements. Slide aperture 27 is located above assembly switch 78 and accommodates slide 28. When slide 28 moves back and forth, it acts as a switch actuator and changes the state of assembly switch 78. As previously mentioned, recess 24 in top 21 of base 20 is located to receive blocking pin 43 from reel housing 40 when reel housing 40 is assembled to base 20.

Figure 9:
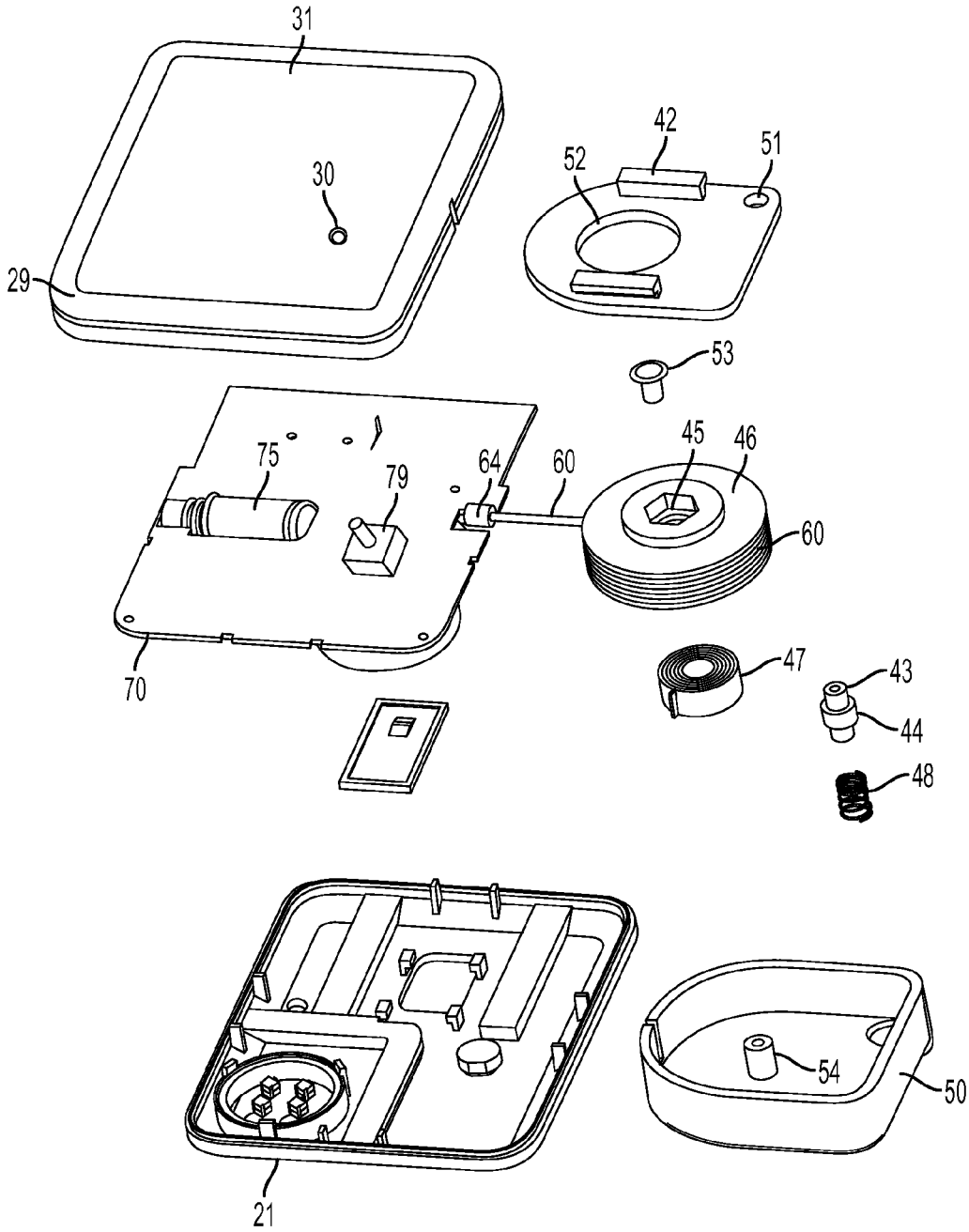
FIG. 9 is an exploded bottom perspective view of an embodiment of a security apparatus with tether.

FIG. 9 is an exploded bottom perspective view of an embodiment of a security apparatus with tether. In FIG. 9, additional electronic elements and aspects are visible. Bottom switch 79 is mounted on the bottom of circuit board 70. Tether 60 connects to circuit board 70 and is, in effect, an electronic, or electrical, element when comprised of a conductive material. Additionally, passive EAS element 75 may be seen protruding through the bottom of circuit board 70 in FIG. 9. In the embodiment shown passive EAS element 75 is a core and coil type element. Other passive elements such as magneto-restrictive elements may also be used, however.

For embodiments having bottom switch 79, bottom 29 of base 20 has bottom aperture 30. Bottom switch 79 aligns with bottom aperture 30 and protrudes through it. Some embodiments of base 20 may have an adhesive element 31 on bottom 29 of base 20 to facilitate the installation of security apparatus 10 on an object to be protected 100.

Microprocessor 71 is capable of storing and executing machine readable instructions. The electronics of security apparatus 10 are powered by onboard power supply 76, which may be a battery or other power storage element. Microprocessor 71 monitors inputs from the various other electronic elements present in security apparatus 10 and executes logic based on those inputs and the machine readable instructions stored in microprocessor. Some inputs are relatively simple, such as switches, other inputs may be more complicated, such as communication with external devices.

Regarding switches, for embodiments of security apparatus 10 having bottom switch 79 protruding from bottom 29 of base 20, the state of bottom switch 79 will inform microprocessor 71 whether base 20 is setting on an object to be protected 100, while the state of assembly switch 78 informs microprocessor 71 whether reel housing 40 is fully coupled to base 20. Referring to FIGS. 6 and 8, slide 28 located in slide aperture 27 in the top 21 of base 20 changes the state of assembly switch 78 when its position is changed. Referring to FIGS. 7 and 9, when reel housing 40 is coupled to base 20, assembly aperture 45 on the bottom of reel 46 in reel housing 40 fits over knob 32 on slide 28, and reel housing 40 changes the position of slide 28 which changes the state of assembly switch 78. This change in state of assembly switch 78 is registered by microprocessor 71 which may initiate various actions, depending on the instructions stored in it.

In some embodiments of security apparatus 10, tether 60 is comprised of conductive material and is connected to circuit board 70. If security apparatus 10 is installed on an object 100 and armed, a circuit can be established through tether 60. Some embodiments of tether 60 have two conductive filaments running along their length with the filaments being insulated from each other except where they terminate within reel housing 40. The filaments may be coaxial. Connection of the two conductors to circuit board 70 produces an electrical circuit which can be monitored by microprocessor 71 to monitor the integrity of tether 60. If the circuit is broken while security apparatus 10 is armed, microprocessor 71 can determine that tether 60 has been cut and that an alarm condition exists. Some embodiments of tether 60 may have only a single conductor running along the length of tether 60. In those embodiments, electrical continuity is established with the end of tether 60 in reel housing 40 by matching electrical contacts on bottom 41 of reel housing 40 and top 21 of base 20. When reel housing 40 is assembled to base 20, these contacts align to produce electrical continuity and create an electrical circuit that can be monitored by microprocessor 71.

Referring now to FIGS. 2, 7, 8, and 9, the bottom of reel 46 is exposed through reel aperture 52. Assembly aperture 45 in bottom of reel 46 in reel housing 40 and knob 32 on slide 28 have the same, non-circular shape. This allows knob 32 to function as a locking element with respect to reel 46 in reel housing 40. The non-circular shape and fixed nature of knob 32 prevents reel 46 from turning once reel housing 40 is place on knob 32. The sliding engagement of reel housing 40 with base 20 takes any remaining slack out of tether 60. Once reel housing 40 is fully coupled to base 20, blocking pin 43 extending from bottom 41 of reel housing 40 engages recess 24 in base 20, releasably locking reel housing 40 in place. Referring to FIG. 9, screw 53 holds reel 46 in place by screwing into boss 54. Reel spring 47 within reel housing 40 provides reel 46 the ability to retract tether 60.

In exploded FIGS. 8 and 9, blocking pin 43 may be fully seen. Biasing spring 48 first around blocking pin 43 and presses against rim 44 of blocking pin 43 to bias it to an extended position. Dome 49 in the top 50 of reel housing 40 provides a visual cue of where to apply a magnet to magnetically attract blocking pin 43 to disengage it from recess 24 in base 20. Once blocking pin 43 is withdrawn from recess 24, reel housing 40 can be uncoupled from base 20 by sliding reel housing 40 so that rails 42 on reel housing 40 disengage slots 23 in base 20. FIG. 10 is an exploded perspective view of embodiments of a housing 20 and base plate 40.

The following describes how at least one embodiment of security apparatus may be installed and function on an object to be protected 100. Adhesive element 31 on the bottom 29 of base 20 is used to initially mount base 20 on an object 100, such as a box. If the particular embodiment of security apparatus 10 has bottom switch 79, the state of bottom switch 79 will change when base 20 is mounted on object 100. This state change for bottom switch 79 will register in microprocessor 71. Reel housing 40 is then pulled around the box until it meets base 20 at which time tether 60 is coupled with tether guide 22 to reroute tether 60, in this case ninety degrees. Reel housing 40 is then passed around the box again but in a plane perpendicular to the previous pass until reel housing 40 meets base 20 again. Assembly aperture 43 in bottom 41 of reel housing 40 is placed over knob 32. Knob 32 locks reel 46, and top 21 of base 20 compresses blocking pin 43 up into reel housing 40. Reel housing 40 is slid to engage rails 42 on the bottom of reel housing 40 with slots 23 in base 20. When reel housing 40 is fully coupled with base 20, blocking pin 43 aligns with recess 24 in base 20 and extends into recess 24, releasably locking reel housing 40 in place. When reel housing 40 slides, it changes the position of slide 28. This, in turn, changes the state of assembly switch 78. The state change of assembly switch 78 is registered in microprocessor 71. In some embodiments of security apparatus 10, as a final step of installing security apparatus 10, security apparatus 10 may be armed by communication from an external device 102.

Referring to FIG. 1 again, external device 102 can give a final arming signal to security apparatus 10. External device 102 may communicate with security apparatus 10 via optical signals to optical communication element 73 or via radio signals to RF circuitry 77 on circuit board 70. In some embodiments, RF receiving and transmitting circuitry 77 functions as a transceiver. In FIG. 1, external device 102 is hand held, but other, larger, external devices could also communicate with security apparatus 10. The optical signals between security apparatus 10 and external device 102 may be in the infra-red range.

Once security apparatus 10 is installed and armed, microprocessor 71 monitors for change of states from inputs. For example, if assembly switch 78 changes state without security apparatus 10 receiving a disarming signal, microprocessor 71 may determine that reel housing 40 has been uncoupled from base 20 without proper authority and generate an alarm. Microprocessor 71 may generate an audio alarm via sound generator 72 or it may generate an electronic alarm by communicating with the larger surveillance system for the premises. Security apparatus 10 can communicate with the larger surveillance system via RF communication circuitry 77 or optical communication port 73 and/or LED 74. Microprocessor 71 also monitors tether 60 for electrical continuity. If microprocessor 71 determines that tether 60 has lost electrical continuity, microprocessor 71 may determine that tether 60 has been cut to remove security apparatus 10 from an object being protected 100 and that an alarm condition therefore exists. Again, microprocessor 71 has several means to communicate an alarm. For embodiments of security apparatus 10 having a bottom switch 79, microprocessor 71 can monitor bottom switch 79 for a state change. If a state change is detected, microprocessor 71 can determine that base 20 has been removed from the object without authorization and that an alarm condition exists and communicate an alarm, either audibly or electronically.

When it is time to remove security apparatus 10 from an object being protected, security apparatus 10 can be disarmed by a disarming signal from external device 102. Once security apparatus 10 is disarmed, a magnet can be applied to dome 49 on top of reel housing 40 of security apparatus 10 to withdraw blocking pin 43 within reel housing 40 from recess 24 in top 21 of base 20. Once blocking pin 43 is withdrawn from recess 24, reel housing 40 can be slid to decouple reel housing 40 from base 20. Reel housing 40 can be passed back around the object, tether 60 disengaged from tether guide 22, and reel housing 40 brought back into proximity to base 20 while reel spring 47 reels tether 60 back into reel housing 40.

Passive EAS element 75 on circuit board 70 provides an additional security feature. If security apparatus 10 is taken into an interrogation field produced by the broader security system, passive EAS element 75 will be induced to produce a signal by the interrogation field. This signal can be detected by the system that creates the interrogation field and inform the broader system that the security apparatus is present in the interrogation field and is presumably being removed from the premises without authorization.

The electronics of some embodiments of security apparatus 10 may have passcode protection. These embodiments are capable of storing a passcode which is required to be matched by the external device such as handheld remote 102 for the communication from the external device to be ascertained as authorized. For further protection the electronics of some embodiments of security apparatus 10 may include a clock generator and the electronics may have machine readable instructions with an algorithm to change the passcode at preprogrammed time intervals. The EAS system, including handheld remote 102, also has at least one clock generator and is capable of updating the passcode at the preset intervals to update the systems record of the passcode. This keeps the passcode between security apparatus 10 and the rest of the EAS system synchronized. Additionally, the passcode can be reprogrammed or reset to bring additional security apparatuses 10 into an established security system.

The machine readable instructions in microprocessor 71 can also be reprogrammed by external devices. This can be done to change the logic and the manner in which various signals are interpreted. The algorithm and start point of the clock can also be adjusted by the external devices.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciated that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An EAS security apparatus comprising:

a base, said base comprising a top surface, a bottom surface, a tether guide, and a first coupling element;

a reel housing comprising a top surface, a bottom surface, a second coupling element, and a side connecting said top surface and said bottom surface, said top surface, bottom surface, and side enclosing a tether reel and a tether disposed upon said reel, said tether having a first end fixed to said reel and a second end attached to said base;

a releasable locking mechanism; and, an electronics package;

said first coupling element and said second coupling element being complimentary to each other for joining said reel housing to said base;

said locking mechanism preventing the removal of said reel housing from said base until said locking mechanism is released.

2. The EAS security apparatus of claim 1, wherein:

the joining of said reel housing to said base maintains said tether in engagement with said tether guide.

3. The EAS security apparatus of claim 1, wherein:

said tether guide comprises a groove in said top surface of said base.

4. The EAS security apparatus of claim 1, wherein:

said base further comprises a side connecting said top surface and said bottom surface;

said side, said top surface, and said bottom surface enclosing an interior space;

said electronics package being enclosed within said interior space.

5. The EAS security apparatus of claim 1, wherein:

said electronics package comprises a passive electronic article surveillance element.

6. The EAS security apparatus of claim 1, wherein:

said passive electronic article surveillance element is a core and coil passive electronic article surveillance element.

7. The EAS security apparatus of claim 1, wherein:

said electronics package comprises a microprocessor, onboard energy supply, and wireless communication elements.

8. The EAS security apparatus of claim 7, wherein:

said wireless communication elements comprise radio frequency transmitting and receiving circuitry.

9. The EAS security apparatus of claim 7, wherein:

said wireless communication elements comprise optical communication elements.

10. The EAS security apparatus of claim 9, wherein:

Said optical communication elements operate in the infrared range.

11. The EAS security apparatus of claim 7, wherein:

said electronics package further comprises an audible signal generator.

12. The EAS security apparatus of claim 7, wherein:

said base further comprises an aperture through said bottom surface; and, said electronics package further comprises a first switch extending through said aperture.

13. The EAS security apparatus of claim 7, wherein:

said electronics package further comprises a second switch operable to detect the joining of said reel housing to said base.

14. The EAS security apparatus of claim 13, wherein:

said base further comprises a switch actuator and when said reel housing is joined to said base, said reel housing engages and moves said switch actuator which changes the state of said second switch.

15. The EAS security apparatus of claim 7, wherein:

said tether comprises a first filament along its length and a second filament along its length;

each said filament being electrically conductive;

said first filament being in electrical continuity with said second filament; and, each said filament being in electrical continuity with said electronics package at said second end of said tether.

16. The EAS security apparatus of claim 15, wherein:

said first filament and said second filament are coaxial.

17. The EAS security apparatus of claim 7, further comprising:

a first electrical contact on said reel housing and a second electrical contact on said base, said second electrical contact being in electrical continuity with said electronics package; wherein, said first electrical contact and said second electrical contact are located to make contact with each other when said reel housing is joined to said base; and, said tether comprises an electrically conductive filament along its length, said filament being in electrical continuity with said first contact and said electronics package.

18. The EAS security apparatus of claim 7, further comprising:

machine readable instructions encoded in said microprocessor for storing a passcode.

19. The EAS security apparatus of claim 18, wherein:

said passcode can be changed by an external device via wireless communication with said wireless communication elements.

20. The EAS security apparatus of claim 18, wherein:

said electronics package further comprises a clock and machine readable instructions encoded for performing an algorithm for generating multiple serial passcodes; and wherein, on a programmed time schedule, said microprocessor generates new passcodes using said algorithm.

21. The EAS security apparatus of claim 1, wherein:

said first coupling element and said second coupling element require a sliding motion between said reel housing and said base to join said reel housing to said base;

said releasable locking mechanism comprises a blocking pin enclosed within said reel housing and biased to extend through an aperture in said reel housing;

said base further comprises a blocking pin receiver; and, said blocking pin and said blocking pin receiver being located to align when said reel housing is joined to said base.

22. The EAS security apparatus of claim 21, wherein:

said blocking pin is at least partially comprised of a magnetically attractable material.

23. The EAS security apparatus of claim 1, further comprising:

adhesive on said bottom surface of said base.

24. The EAS security apparatus of claim 23, wherein:

said adhesive is a pressure sensitive adhesive pad.

* * * * *